US011103984B2

(12) United States Patent
Kuo

(10) Patent No.: US 11,103,984 B2
(45) Date of Patent: Aug. 31, 2021

(54) TORQUE WRENCH

(71) Applicant: Wen-Chin Kuo, Taichung (TW)

(72) Inventor: Wen-Chin Kuo, Taichung (TW)

( * ) Notice: Subject to any disclaimer, the term of this patent is extended or adjusted under 35 U.S.C. 154(b) by 272 days.

(21) Appl. No.: 16/452,596

(22) Filed: Jun. 26, 2019

(65) Prior Publication Data

US 2020/0406435 A1 Dec. 31, 2020

(51) Int. Cl.
*B25B 23/142* (2006.01)
*B25B 23/16* (2006.01)

(52) U.S. Cl.
CPC ..... *B25B 23/1427* (2013.01); *B25B 23/16* (2013.01)

(58) Field of Classification Search
CPC ... B25B 23/14; B25B 23/142; B25B 23/1427; B25B 23/16
See application file for complete search history.

(56) References Cited

U.S. PATENT DOCUMENTS

| | | | | |
|---|---|---|---|---|
| 6,463,834 | B2 * | 10/2002 | Kemp | B25B 23/1427 81/467 |
| 9,700,999 | B2 * | 7/2017 | Hsieh | B25B 23/1427 |
| 10,093,007 | B2 * | 10/2018 | Chen | B25B 23/1427 |
| 10,179,396 | B2 * | 1/2019 | Hsieh | B25B 23/1425 |
| 10,702,979 | B2 * | 7/2020 | Chen | B25B 23/0007 |

* cited by examiner

*Primary Examiner* — David B. Thomas
(74) *Attorney, Agent, or Firm* — Alan D. Kamrath; Karin L. Williams; Mayer & Williams PC

(57) ABSTRACT

A torque wrench includes a main body, a holder, an adjusting member, and at least one first washer. The main body has a receiving recess. The holder has a first threaded portion. The adjusting member is provided with a second threaded portion, a head portion, a first abutting face, a second abutting face, and an annular groove. The at least one first washer is mounted in the annular groove of the adjusting member. Thus, when the head portion is moved toward the holder by rotation of the second threaded portion relative to the first threaded portion, the at least one first washer is moved to abut the holder, thereby providing a buffering effect between the head portion and the holder, and thereby preventing the head portion from directly hitting the holder.

10 Claims, 12 Drawing Sheets

C-C

TORQUE WRENCH

BACKGROUND OF THE INVENTION

1. Field of the Invention

The present invention relates to a hand tool and, more particularly, to a torque (or torsion) wrench.

2. Description of the Related Art

A conventional torque wrench 90 in accordance with the prior art shown in FIGS. 16 and 17 comprises a main body 91, a holder 92, a plurality of fasteners 93, an threaded rod 94, and a handle 96. The main body 91 has a first end provided with an operation portion and a second end provided with a receiving recess 912 and a plurality of first fixing portions 913. A torsion spring is mounted in the receiving recess 912. The holder 92 is secured in the receiving recess 912. The holder 92 has an interior provided with a first threaded portion 921 and has a periphery provided with a plurality of second fixing portions 922 aligning with the first fixing portions 913. The fasteners 93 extend through the first fixing portions 913 and the second fixing portions 922, such that the holder 92 is secured in the receiving recess 912. The threaded rod 94 is received in the receiving recess 912 and partially protrudes from the main body 91. The threaded rod 94 is provided with a second threaded portion 941 screwed through the first threaded portion 921. The threaded rod 94 has a first end provided with a head portion 942 and a second end provided with a fitting portion. The torsion spring 17 is biased between the main body 91 and the head portion 942. The handle 96 is rotatable relative to the main body 91 and connected with the fitting portion of the threaded rod 94 such that the threaded rod 94 is rotated by the handle 96. In operation, when the handle 96 is rotated relative to the main body 91, the threaded rod 94 is rotated by the handle 96, and the second threaded portion 941 is rotated and moved relative to the first threaded portion 921, such that the threaded rod 94 is moved forward or backward relative to the holder 92, to regulate the tension of the torsion spring, and to adjust the torque value of the torque wrench.

However, when the second threaded portion 941 of the threaded rod 94 is rotated and moved relative to the first threaded portion 921 of the holder 92, the head portion 942 of the threaded rod 94 is moved to hit the holder 92, such that the head portion 942 of the threaded rod 94 or the holder 92 will be damaged due to the collision. In addition, if the operator continuously rotates the handle 96 after the head portion 942 of the threaded rod 94 presses the holder 92, the force of the handle 96 is transmitted through the threaded rod 94 and the holder 92 to the fasteners 93, such that the fasteners 93 are easily broken or worn out due to an excessive rotation force, and the holder 92 is easily detached from the receiving recess 912, thereby failing the torque wrench.

BRIEF SUMMARY OF THE INVENTION

The primary objective of the present invention is to provide a torque wrench having a washer to provide a buffering effect.

In accordance with the present invention, there is provided a torque wrench comprising a main body, a holder, an adjusting member, and at least one first washer. The main body has a receiving recess. The holder has a first threaded portion. The adjusting member is provided with a second threaded portion, a head portion, a first abutting face, a second abutting face, and an annular groove. The at least one first washer is mounted in the annular groove of the adjusting member. Thus, when the head portion is moved toward the holder by rotation of the second threaded portion relative to the first threaded portion, the at least one first washer is moved to abut the holder, thereby providing a buffering effect between the head portion and the holder, and thereby preventing the head portion from directly hitting the holder.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
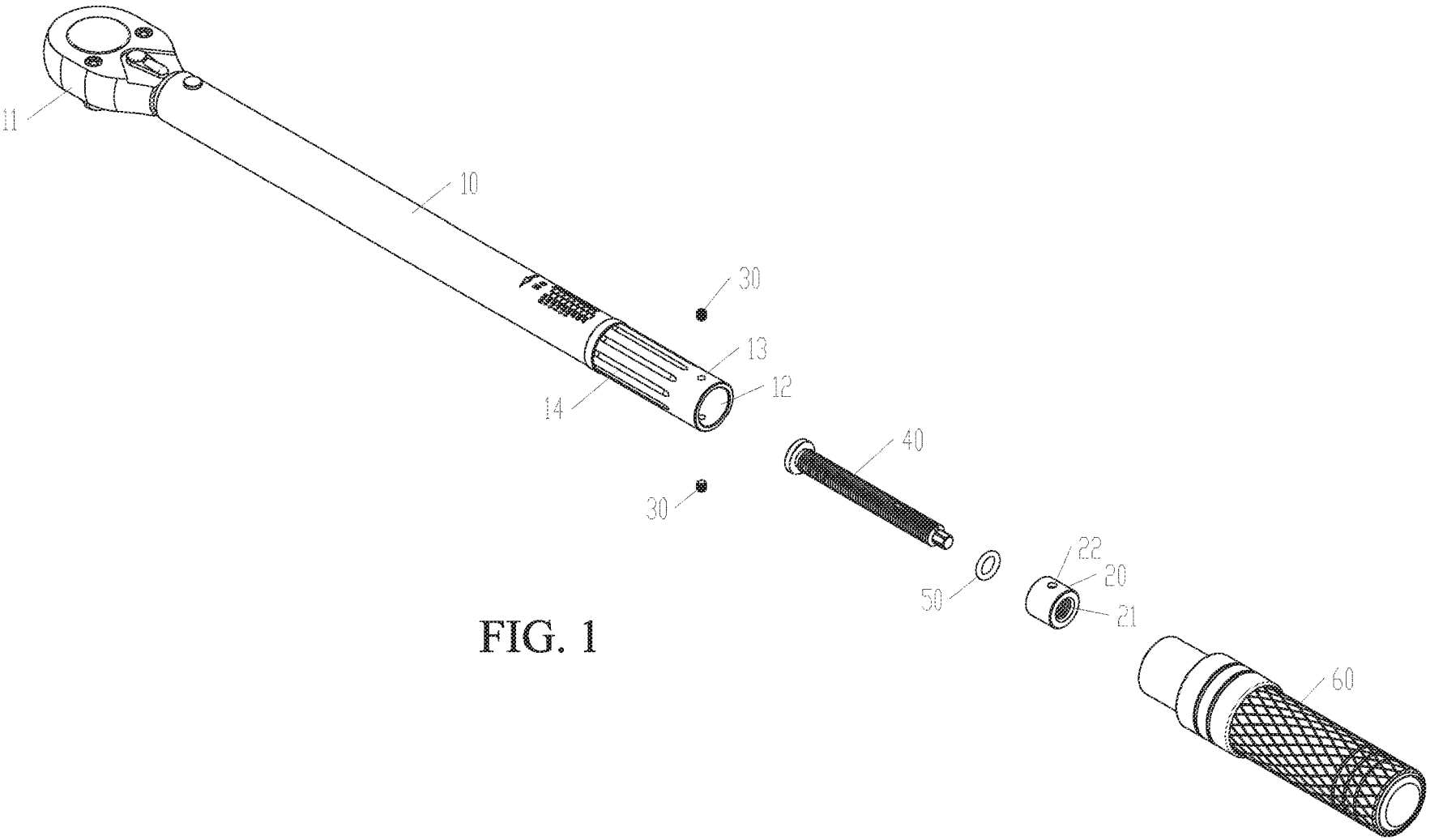
FIG. 1 is an exploded perspective view of a torque wrench in accordance with the preferred embodiment of the present invention.

Referring to the drawings and initially to FIGS. 1-8, a torque wrench in accordance with the preferred embodiment of the present invention comprises a main body 10, a holder 20, a plurality of fasteners 30, an adjusting member 40, at least one first washer 50, and a handle 60.

The main body 10 has a first end provided with an operation portion 11 and a second end provided with a receiving recess 12 and a plurality of first fixing portions 13. The operation portion 11 is a ratchet wrench structure. The first fixing portions 13 are connected to the receiving recess 12 and located adjacent to an opening of the receiving recess 12. The first fixing portions 13 are arranged annularly along an axis of the receiving recess 12. The receiving recess 12 has a peripheral face provided with a plurality of locking channels 14 which extend longitudinally and are arranged annularly. A torsion spring 17 is mounted in the receiving recess 12, and a resting member 18 is mounted in the receiving recess 12 and rests on the torsion spring 17.

The holder 20 has a ring shape and is secured in the receiving recess 12. The holder 20 has an interior provided with a first threaded portion 21 and has a periphery provided with a plurality of second fixing portions 22 aligning with the first fixing portions 13. The first threaded portion 21 is an internal thread which extends through the holder 20.

The fasteners 30 extend through the first fixing portions 13 and the second fixing portions 22, such that the holder 20 is secured in and will not be detached from the receiving recess 12. Each of the fasteners 30 does not protrude from a peripheral face of the main body 10.

The adjusting member 40 is received in the receiving recess 12 and partially protrudes from the main body 10. The adjusting member 40 is provided with a second threaded portion 41 screwed through the first threaded portion 21. The second threaded portion 41 is an external thread. The adjusting member 40 has a first end provided with a head portion 42 and a second end provided with a fitting portion 46. The head portion 42 has a first abutting face 43 and a second abutting face 44 spaced from each other. The first abutting face 43 is located between the second threaded portion 41 and the second abutting face 44. The resting member 18 is located between the torsion spring 17 and the second abutting face 44, and the torsion spring 17 is biased between the main body 10 and the resting member 18. The adjusting member 40 is provided with an annular groove 45 which is located between the second threaded portion 41 and the first abutting face 43. The annular groove 45 has an outer diameter smaller than that of the second threaded portion 41 or smaller than a root diameter of the second threaded portion 41. The second threaded portion 41 is located between the head portion 42 and the fitting portion 46. The fitting portion 46 has a noncircular shape, such as a hexagonal shape.

In practice, when the second threaded portion 41 is rotated relative to the first threaded portion 21, the second threaded portion 41 is displaced relative to the first threaded portion 21, such that the adjusting member 40 is moved relative to the holder 20 and moved forward or backward relative to the main body 10, to regulate a tension (or compression extent) of the torsion spring 17, and to adjust a torque value of the torque wrench. When the head portion 42 is moved away from the holder 20, the torsion spring 17 is more compressed by the head portion 42, and the torque wrench has a greater torque value.

The at least one first washer 50 is mounted in the annular groove 45 of the adjusting member 40 and rests on the first abutting face 43. The at least one first washer 50 is made of resilient and elastic material, and has an outer diameter smaller than that of the head portion 42. A closely fit structure is defined between the at least one first washer 50 and the annular groove 45, to prevent the at least one first washer 50 from being detached from the annular groove 45.

In practice, when the head portion 42 is moved toward the holder 20 by rotation of the second threaded portion 41 relative to the first threaded portion 21, the at least one first washer 50 is moved to abut the holder 20, and to space the head portion 42 from the holder 20, thereby providing a buffering effect between the head portion 42 and the holder 20, and thereby preventing the head portion 42 from directly hitting the holder 20. When the at least one first washer 50 rests on the holder 20, the at least one first washer 50 is located between the first abutting face 43 of the head portion 42 and the holder 20.

The handle 60 is mounted on and rotatable relative to the main body 10. The handle 60 has an interior provided with a restriction mechanism (not labeled) that is locked in one of the locking channels 14, to lock the handle 60 onto the main body 10 temporarily. The fitting portion 46 of the adjusting member 40 is secured in and rotated by the handle 60.

In practice, when the restriction mechanism is unlocked from one of the locking channels 14, the handle 60 is released from the main body 10, such that the handle 60 is rotatable relative to the main body 10. Thus, when the handle 60 is rotated relative to the main body 10, the adjusting member 40 is rotated by the handle 60, and the second threaded portion 41 is rotated and moved relative to the first threaded portion 21, such that the adjusting member 40 is moved forward or backward relative to the holder 20, and the handle 60 is moved forward or backward relative to the main body 10.

In the preferred embodiment of the present invention, the receiving recess 12 has a circular shape, and each of the fasteners 30 is an external thread.

In the preferred embodiment of the present invention, the main body 10 is provided with two first fixing portions 13 which arranged symmetrically. Each of the two first fixing portions 13 is a circular through hole.

In the preferred embodiment of the present invention, the at least one first washer 50 is made of plastic material or rubber material.

In the preferred embodiment of the present invention, the at least one first washer 50 has a ring shape and has a cross-sectional profile of circular shape.

Figure 2:
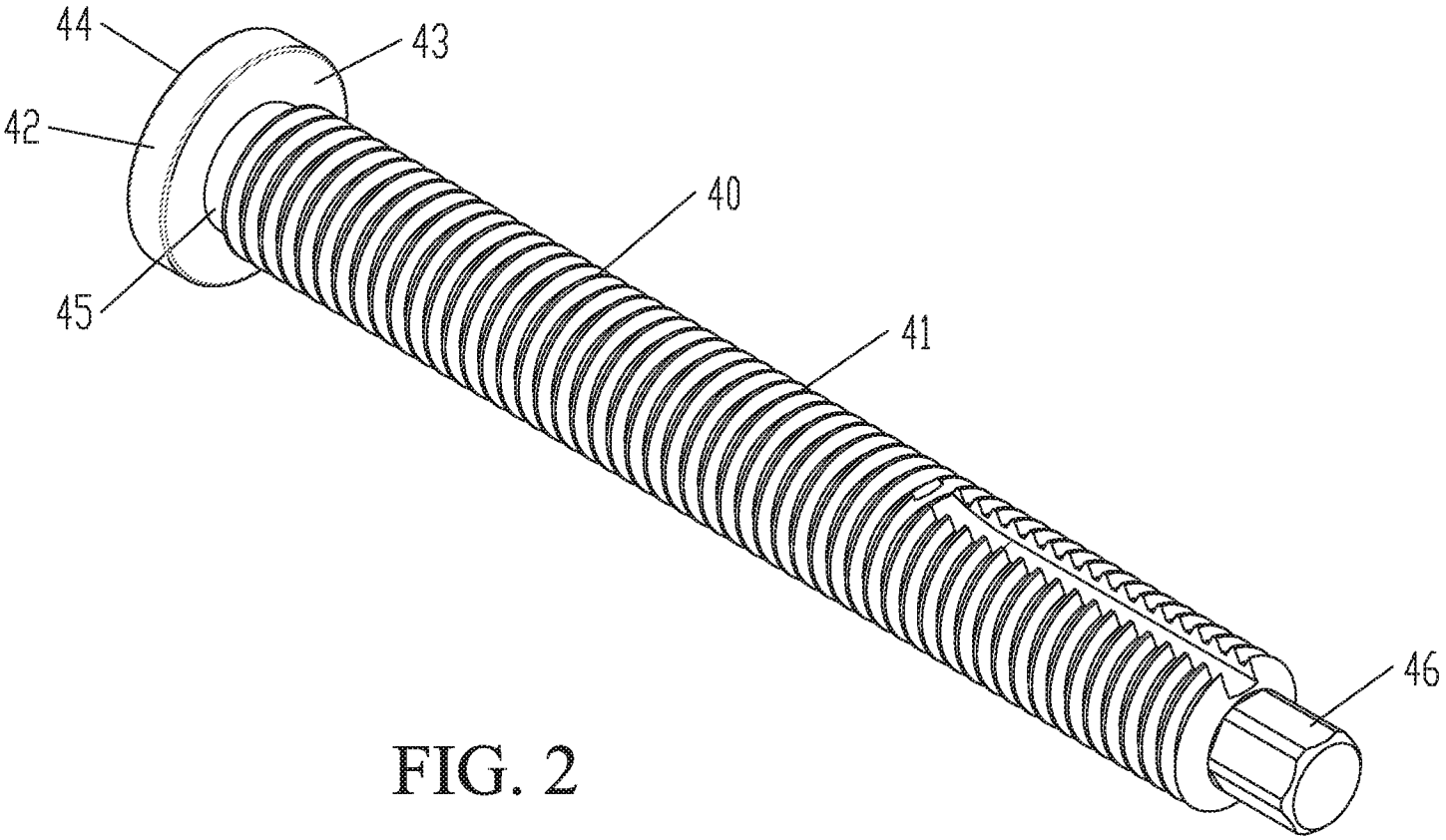
FIG. 2 is a perspective view of an adjusting member of the torque wrench in accordance with the preferred embodiment of the present invention.
Figure 3:
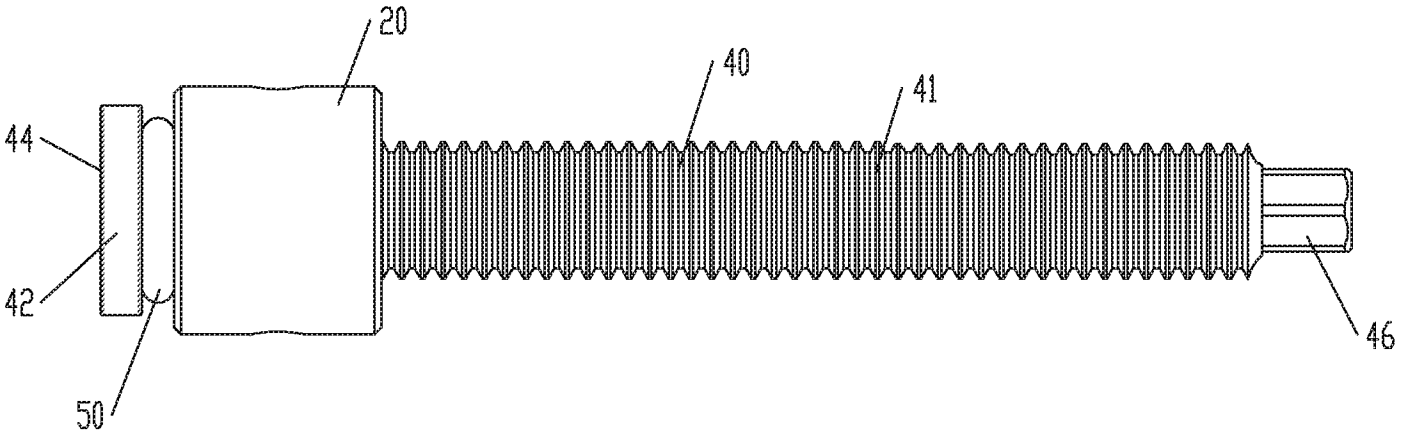
FIG. 3 is a partial front assembly view of the torque wrench as shown in FIG. 1.
Figure 4:
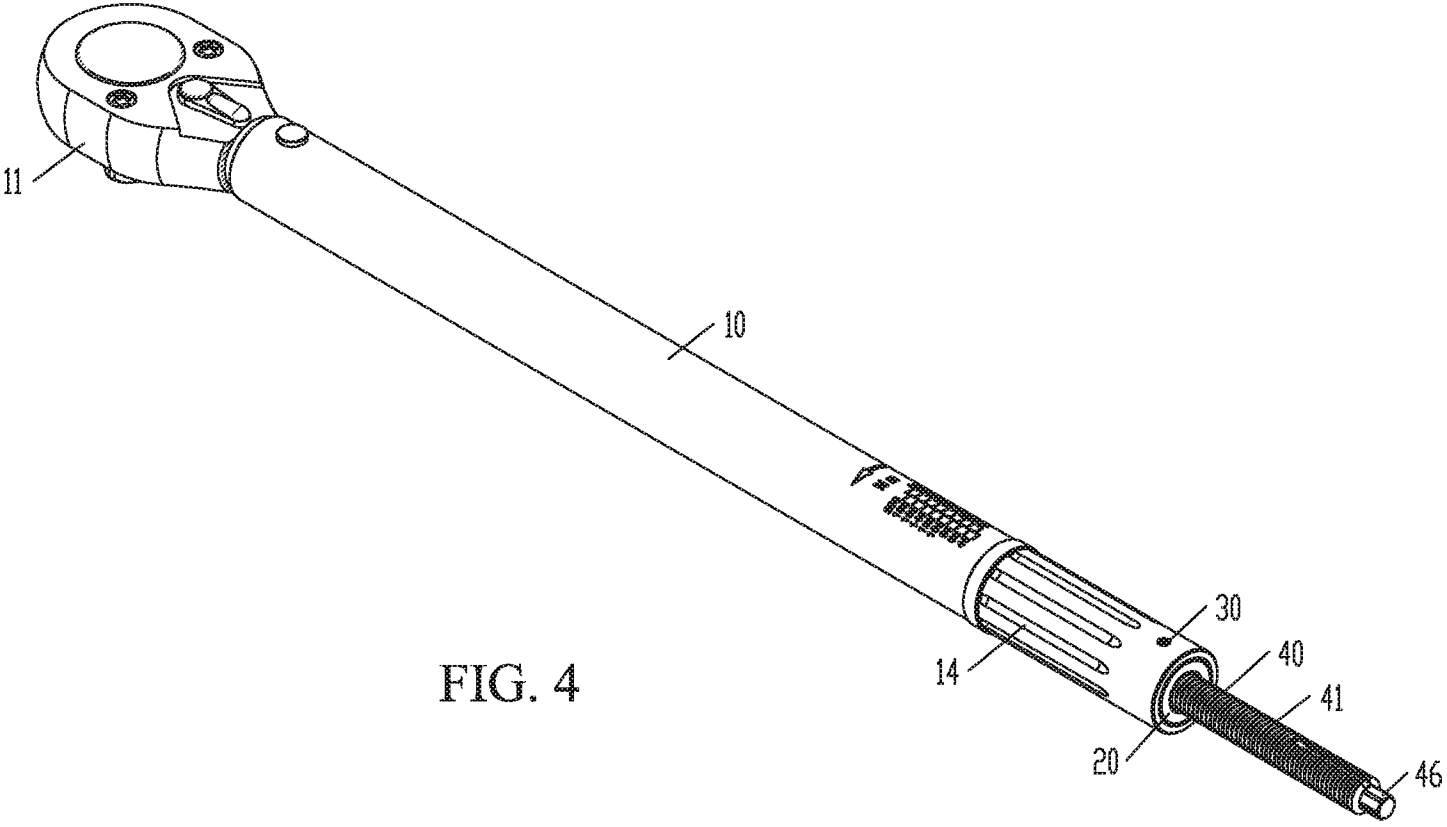
FIG. 4 is a partial perspective assembly view of the torque wrench as shown in FIG. 1.
Figure 5:
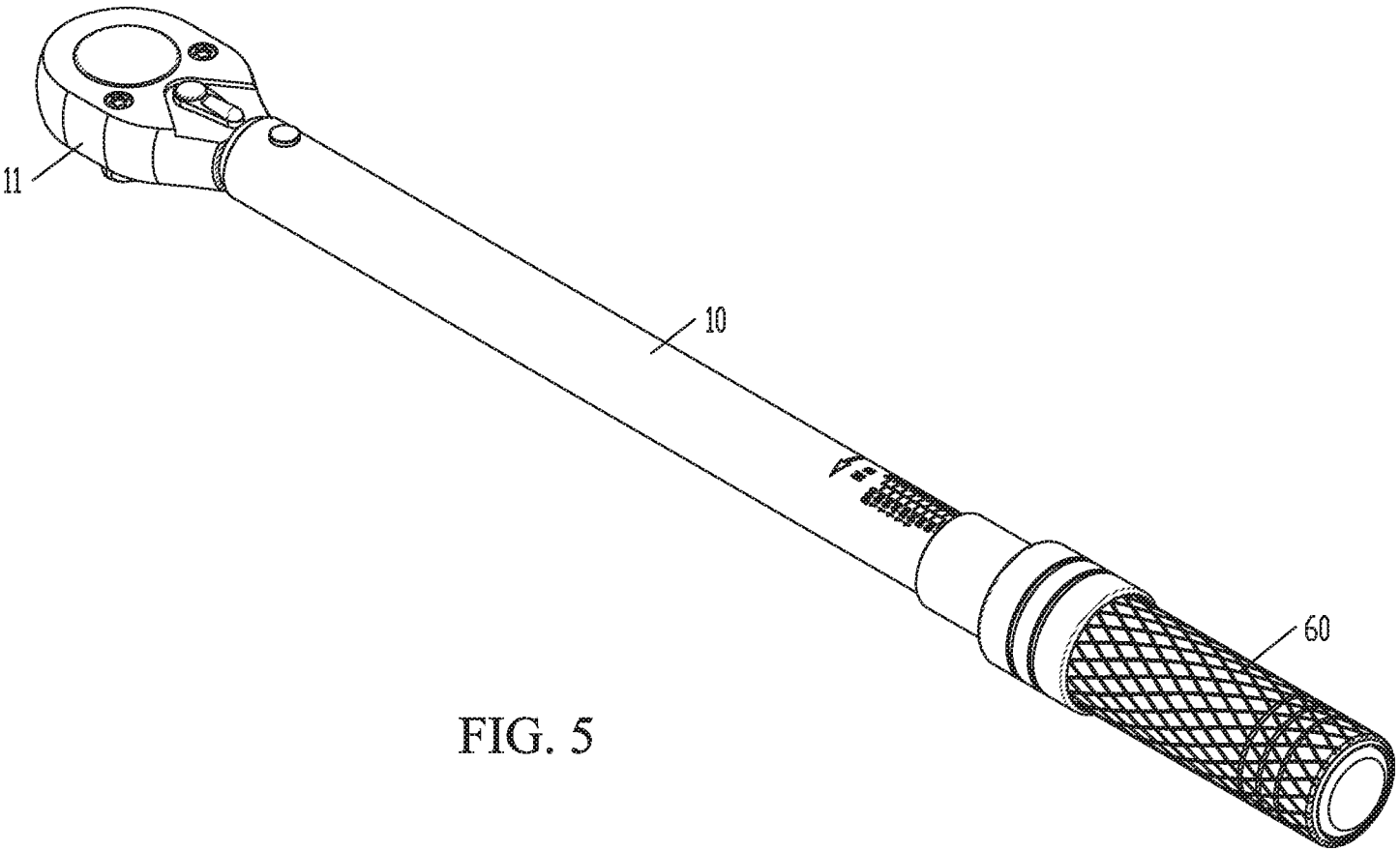
FIG. 5 is a perspective assembly view of the torque wrench as shown in FIG. 1.
Figure 6:
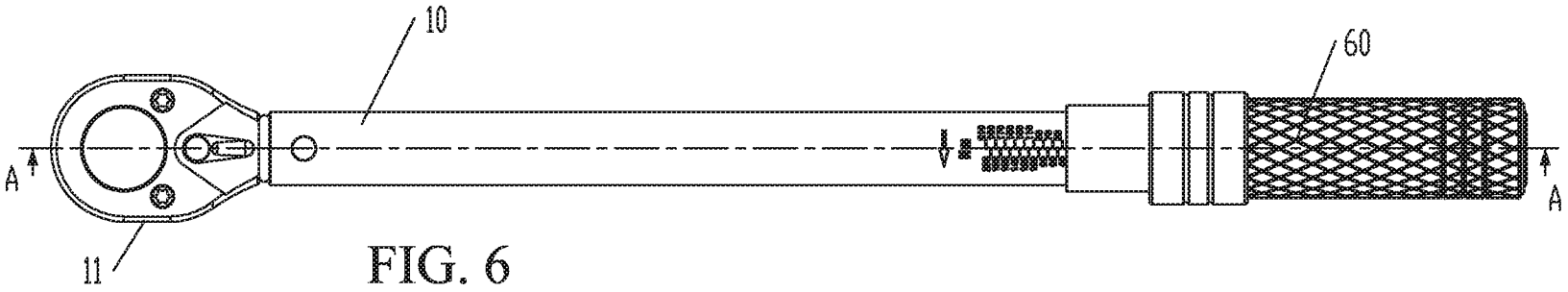
FIG. 6 is a top view of the torque wrench as shown in FIG. 5.
Figure 7:
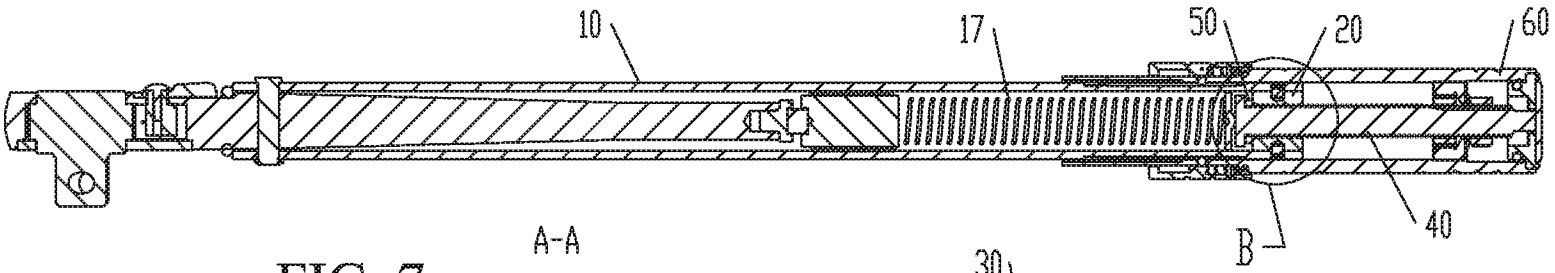
FIG. 7 is a cross-sectional view of the torque wrench taken along line A-A as shown in FIG. 6.
Figure 8:
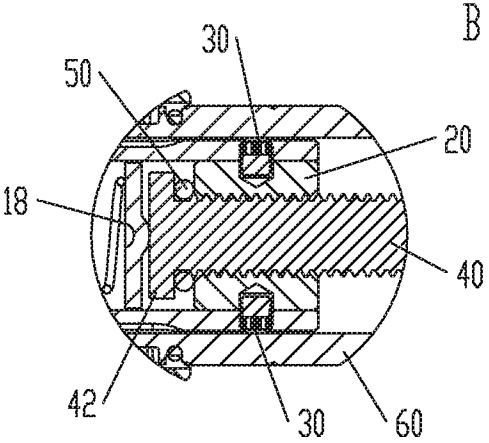
FIG. 8 is a locally enlarged view of the torque wrench taken along mark "B" as shown in FIG. 7.

Referring to FIGS. 4-8 with reference to FIGS. 1-3, the holder 20 is received in the receiving recess 12. The fasteners 30 extend through the first fixing portions 13 and the second fixing portions 22, such that the holder 20 is secured in the receiving recess 12. The adjusting member 40 extends through the receiving recess 12 and is screwed through the first threaded portion 21. The adjusting member 40 partially protrudes from the main body 10. The at least one first washer 50 is mounted in the annular groove 45. The handle 60 is mounted on and rotatable relative to the main body 10. When the handle 60 is rotated relative to the main body 10, the adjusting member 40 is rotated by the handle 60, and the second threaded portion 41 is rotated and moved relative to the first threaded portion 21, such that the adjusting member 40 is moved forward or backward relative to the holder 20. When the head portion 42 is moved toward the holder 20 by rotation of the second threaded portion 41 relative to the first threaded portion 21, the at least one first washer 50 is moved to abut the holder 20 as shown in FIG. 3, such that the at least one first washer 50 is located between the holder 20 and the first abutting face 43 of the head portion 42.

Figure 9:
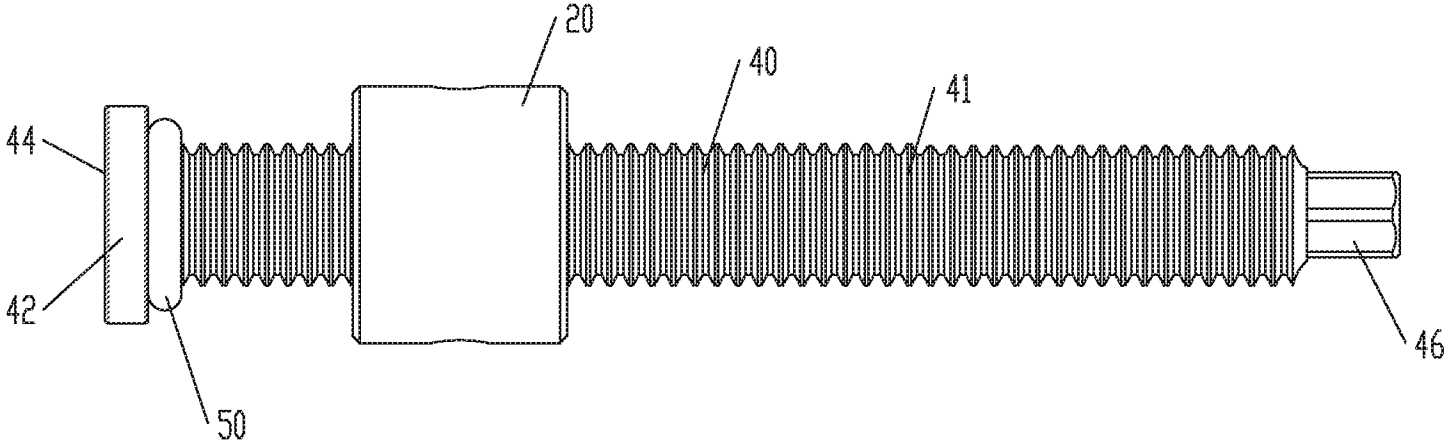
FIG. 9 is a schematic operational view of the torque wrench as shown in FIG. 3.
Figure 10:
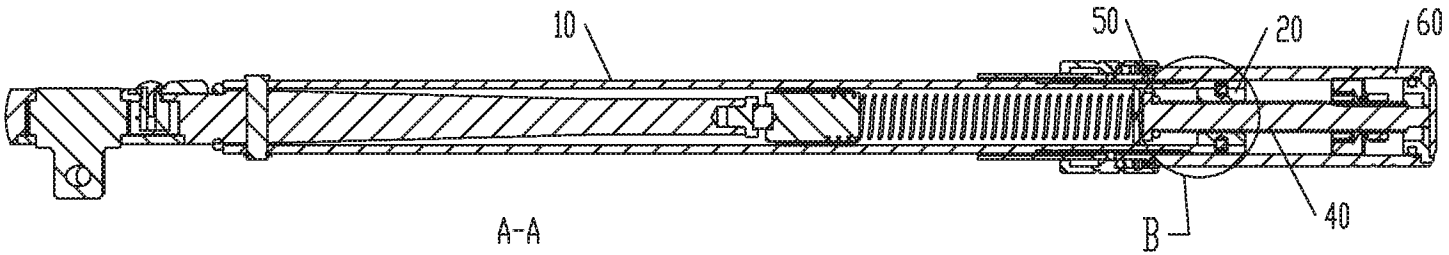
FIG. 10 is a schematic operational view of the torque wrench as shown in FIG. 7.
Figure 11:
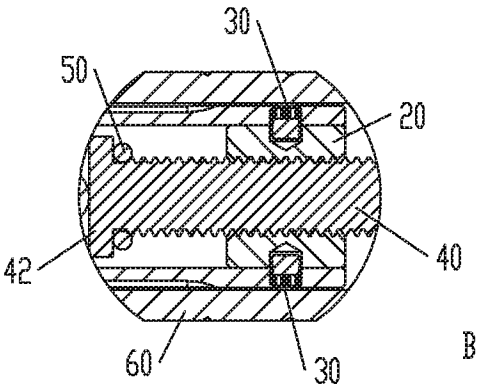
FIG. 11 is a locally enlarged view of the torque wrench taken along mark "B" as shown in FIG. 10.

In operation, referring to FIGS. 9-11 with reference to FIGS. 1-8, when the head portion 42 is moved away from the holder 20 by reverse rotation of the second threaded portion 41 relative to the first threaded portion 21, the at least one first washer 50 is moved and detached from the holder 20 as shown in FIG. 9. Thus, the at least one first washer 50 is moved by rotation of the handle 60, so as to abut the holder 20 as shown in FIG. 3 or to detach from the holder 20 as shown in FIG. 9.

Figure 13:
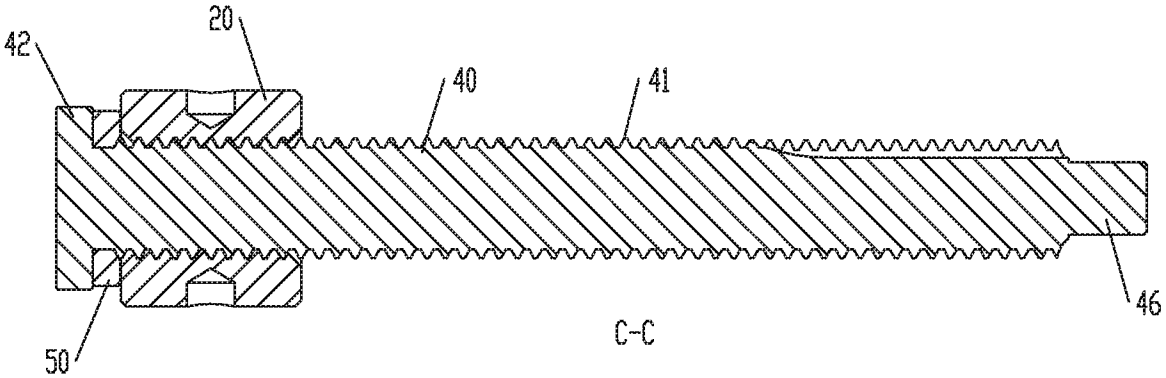
FIG. 13 is a cross-sectional view of the torque wrench taken along line C-C as shown in FIG. 12.
Figure 12:
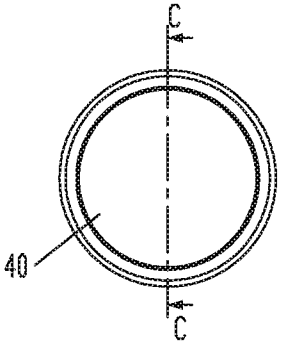
FIG. 12 is a side view of a partial structure of a torque wrench in accordance with the second preferred embodiment of the present invention.

Referring to FIGS. 12 and 13, the at least one first washer 50 has a cross-sectional profile of tetragonal shape.

Figures 14, 15:
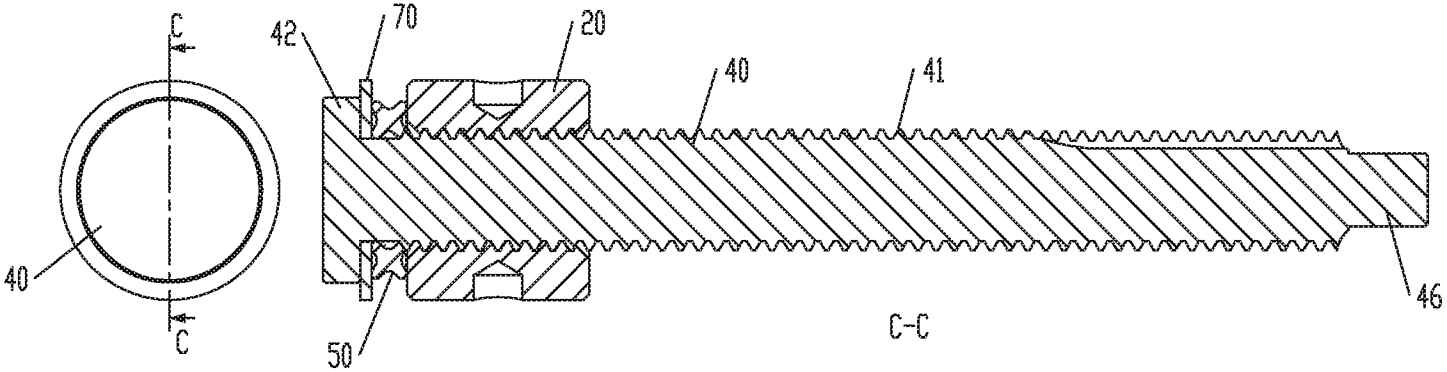
FIG. 14 is a side view of a partial structure of a torque wrench in accordance with the third preferred embodiment of the present invention.
FIG. 15 is a cross-sectional view of the torque wrench taken along line C-C as shown in FIG. 14.
Figure 16:
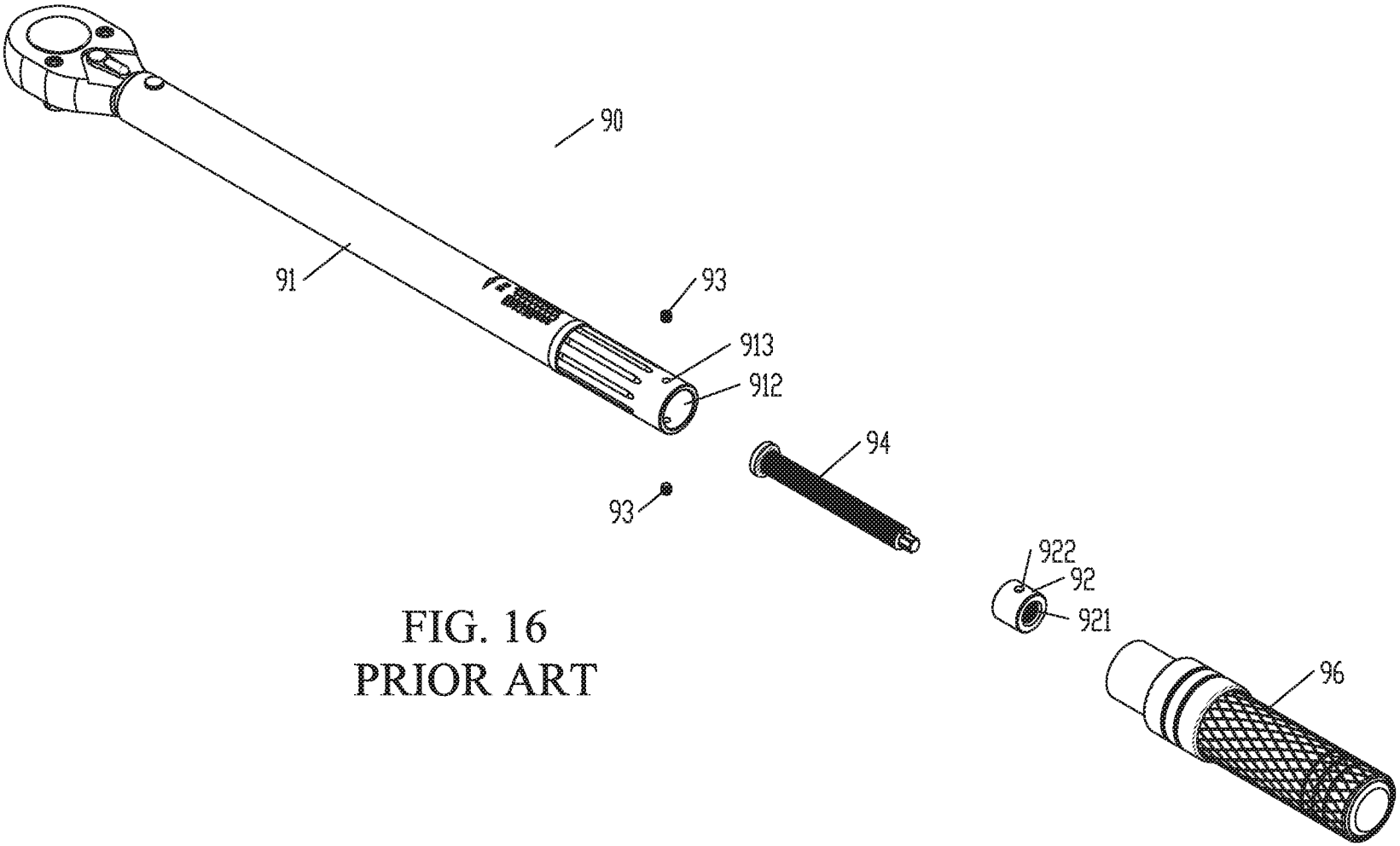
FIG. 16 PRIOR ART
FIG. 16 is an exploded perspective view of a conventional torque wrench in accordance with the prior art.
Figure 17:
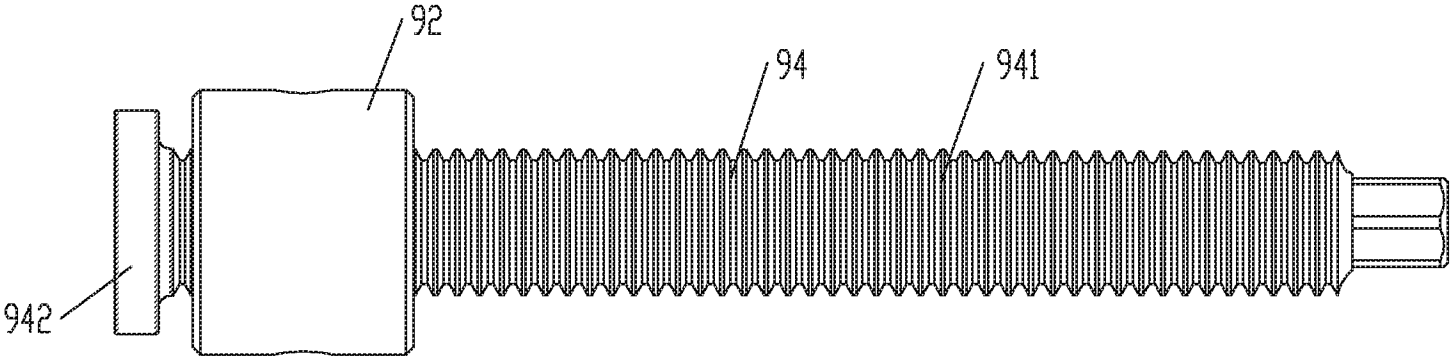
FIG. 17 PRIOR ART
FIG. 17 is a partial front assembly view of the conventional torque wrench as shown in FIG. 16.

Referring to FIGS. 14 and 15, the at least one first washer 50 has a cross-sectional profile of X-shape. Alternatively, the at least one first washer 50 has a cross-sectional profile of B-shape, C-shape, D-shape, E-shape, H-shape, K-shape, M-shape, N-shape, S-shape, U-shape or V-shape.

The torque wrench further comprises at least one second washer 70 mounted in the annular groove 45 of the adjusting member 40, and resting on the at least one first washer 50. The at least one first washer 50 is sandwiched between the at least one second washer 70 and the holder 20 when the at least one first washer 50 is moved to abut the holder 20. The at least one second washer 70 is made of hard material and has an outer diameter equal to or slightly smaller than an inner diameter of the receiving recess 12, such that the at least one second washer 70 enhances a support force (or a structural strength) between the adjusting member 40 and the receiving recess 12.

In the preferred embodiment of the present invention, the at least one second washer 70 is located between the head portion 42 and the at least one first washer 50. Alternatively, the at least one second washer 70 is located between the at least one first washer 50 and the holder 20.

In the preferred embodiment of the present invention, a loosely fit structure is defined between the at least one second washer 70 and the annular groove 45 of the adjusting member 40.

In the preferred embodiment of the present invention, a loosely fit structure is defined between the at least one second washer 70 and the receiving recess 12.

Accordingly, when the head portion 42 is moved toward the holder 20, the at least one first washer 50 is moved to abut the holder 20, so as to provide a buffering effect between the head portion 42 and the holder 20, thereby preventing the head portion 42 from directly hitting the holder 20, and thereby preventing the head portion 42 from being damaged due to collision. In addition, when the at least one first washer 50 presses the holder 20, the torque of the torque wrench reaches the limit, such that the at least one first washer 50 provides a buffering effect and avoids the rotation force of the head portion 42 from directly applying on the holder 20 during a further rotation of the adjusting member 40, thereby preventing the fasteners 30 from being broken due to the excessive force. Further, the at least one first washer 50 is made of resilient and elastic material, and has different cross-sectional profiles. Further, a closely fit structure is defined between the at least one first washer 50 and the annular groove 45, to prevent the at least one first washer 50 from being detached from the annular groove 45. Further, the annular groove 45 has an outer diameter smaller than the root diameter of the second threaded portion 41, to further prevent the at least one first washer 50 from being detached from the annular groove 45. Further, when the handle 60 is rotated relative to the main body 10, the adjusting member 40 is rotated by the handle 60, and the second threaded portion 41 is rotated and moved relative to the first threaded portion 21, such that the adjusting member 40 is moved forward or backward relative to the holder 20, to regulate the tension of the torsion spring 17, and to adjust the torque value of the torque wrench. Further, the at least one second washer 70 forms a support structure between the adjusting member 40 and the receiving recess 12. Further, when the head portion 42 is moved away from the holder 20, the torsion spring 17 is compressed by and applies a larger reaction force on the head portion 42, such that the support structure formed by the at least one second washer 70 supports the head portion 42 exactly. Further, the at least one second washer 70 is rotatable relative to the annular groove 45 of the adjusting member 40, to reduce a friction loss therebetween. Further, the at least one second washer 70 is rotatable relative to the receiving recess 12 of the main body 10, to reduce a friction loss therebetween.

In another preferred embodiment of the present invention, the torque wrench comprises a plurality of second washers 70 which are arranged on one side of the at least one first washer 50 or arranged on two sides of the at least one first washer 50.

In another preferred embodiment of the present invention, the torque wrench comprises a plurality of first washers 50 having different cross-sectional profiles.

In another preferred embodiment of the present invention, the first washers 50 and the second washers 70 are arranged linearly and alternatingly, such that each of the first washers 50 is located between two of the second washers 70, and each of the second washers 70 is located between two of the first washers 50.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A torque wrench comprising:

a main body, a holder, a plurality of fasteners, an adjusting member, at least one first washer, and a handle;

wherein:

the main body has a first end provided with an operation portion and a second end provided with a receiving recess and a plurality of first fixing portions;

a torsion spring is mounted in the receiving recess;

a resting member is mounted in the receiving recess and rests on the torsion spring;

the holder is secured in the receiving recess;

the holder has an interior provided with a first threaded portion and has a periphery provided with a plurality of second fixing portions aligning with the first fixing portions;

the fasteners extend through the first fixing portions and the second fixing portions, such that the holder is secured in the receiving recess;

the adjusting member is received in the receiving recess and partially protrudes from the main body;

the adjusting member is provided with a second threaded portion screwed through the first threaded portion;

the adjusting member has a first end provided with a head portion and a second end provided with a fitting portion;

the head portion has a first abutting face and a second abutting face spaced from each other;

the first abutting face is located between the second threaded portion and the second abutting face;

the resting member is located between the torsion spring and the second abutting face;

the torsion spring is biased between the main body and the resting member;

the adjusting member is provided with an annular groove which is located between the second threaded portion and the first abutting face;

the annular groove has an outer diameter smaller than that of the second threaded portion or smaller than a root diameter of the second threaded portion;

the second threaded portion is located between the head portion and the fitting portion;

the at least one first washer is mounted in the annular groove of the adjusting member and rests on the first abutting face;

the at least one first washer is made of resilient material, and has an outer diameter smaller than that of the head portion;

a closely fit structure is defined between the at least one first washer and the annular groove, to prevent the at least one first washer from being detached from the annular groove;

when the head portion is moved toward the holder by rotation of the second threaded portion relative to the first threaded portion, the at least one first washer is moved to abut the holder, and to space the head portion from the holder, thereby providing a buffering effect between the head portion and the holder, and thereby preventing the head portion from directly hitting the holder;

when the at least one first washer rests on the holder, the at least one first washer is located between the first abutting face of the head portion and the holder;

the handle is mounted on and rotatable relative to the main body; and the fitting portion of the adjusting member is secured in and rotated by the handle.

2. The torque wrench of claim 1, wherein the receiving recess has a circular shape, and each of the fasteners is an external thread.

3. The torque wrench of claim 1, wherein the main body is provided with two first fixing portions which arranged symmetrically, and each of the two first fixing portions is a circular through hole.

4. The torque wrench of claim 1, wherein the at least one first washer is made of plastic material or rubber material.

5. The torque wrench of claim 1, wherein the at least one first washer has a ring shape and has a cross-sectional profile of circular shape, tetragonal shape, X-shape, B-shape, C-shape, D-shape, E-shape, H-shape, K-shape, M-shape, N-shape, S-shape, U-shape or V-shape.

6. The torque wrench of claim 1, further comprising:

at least one second washer mounted in the annular groove of the adjusting member, and resting on the at least one first washer;

wherein the at least one second washer is made of hard material and has an outer diameter equal to or slightly smaller than an inner diameter of the receiving recess.

7. The torque wrench of claim 6, wherein:

the at least one second washer is located between the head portion and the at least one first washer or located between the at least one first washer and the holder;

a loosely fit structure is defined between the at least one second washer and the annular groove of the adjusting member; and a loosely fit structure is defined between the at least one second washer and the receiving recess.

8. The torque wrench of claim 6, wherein the torque wrench comprises a plurality of second washers which are arranged on one side of the at least one first washer or arranged on two sides of the at least one first washer.

9. The torque wrench of claim 6, wherein:

the torque wrench comprises a plurality of second washers and a plurality of first washers; and the first washers and the second washers are arranged linearly and alternatingly, such that each of the first washers is located between two of the second washers, and each of the second washers is located between two of the first washers.

10. The torque wrench of claim 1, wherein the torque wrench comprises a plurality of first washers having different cross-sectional profiles.

* * * * *